US007854216B2

(12) United States Patent
Kasai et al.

(10) Patent No.: US 7,854,216 B2
(45) Date of Patent: Dec. 21, 2010

(54) GENERAL PURPOSE INTERNAL COMBUSTION ENGINE

(75) Inventors: Akihito Kasai, Saitama (JP); Eiichi Utsugi, Saitama (JP); Sohei Honda, Saitama (JP); Hiroaki Kojima, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/383,168

(22) Filed: Mar. 20, 2009

(65) Prior Publication Data

US 2009/0266334 A1 Oct. 29, 2009

(30) Foreign Application Priority Data

Apr. 25, 2008 (JP) ..... 2008-115605
Apr. 25, 2008 (JP) ..... 2008-115606

(51) Int. Cl.
*F02D 9/10* (2006.01)
*F02D 11/04* (2006.01)

(52) U.S. Cl. ..... 123/336; 123/400

(58) Field of Classification Search ..... 123/336, 123/337, 400, 442
See application file for complete search history.

(56) References Cited

U.S. PATENT DOCUMENTS 3,669,636 A * 6/1972 Garretson et al. ..... 48/180.1
3,886,917 A * 6/1975 Nakada et al. ..... 261/39.4
4,243,001 A * 1/1981 Yamada ..... 123/583
4,344,396 A * 8/1982 Yamada ..... 123/337
4,524,742 A * 6/1985 Bonfiglioli et al. ..... 123/438
4,631,153 A * 12/1986 Tamba et al. ..... 261/52
4,983,330 A * 1/1991 Harbeke ..... 261/52
6,000,683 A * 12/1999 Van Allen ..... 261/52
6,202,989 B1 * 3/2001 Pattullo ..... 261/52
6,439,547 B1 * 8/2002 King et al. ..... 261/52
6,454,245 B2 * 9/2002 Kobayashi ..... 261/52
6,494,439 B1 * 12/2002 Collins ..... 261/52
6,896,245 B2 * 5/2005 Suzuki et al. ..... 261/23.2
6,945,231 B2 * 9/2005 Iida ..... 123/442
6,957,633 B2 * 10/2005 Toda et al. ..... 123/65 R (Continued)

FOREIGN PATENT DOCUMENTS

JP 61-61954 * 3/1986

(Continued)

*Primary Examiner*—Hai H Huynh
(74) *Attorney, Agent, or Firm*—Carrier Blackman & Associates, P.C.; William D. Blackman; Joseph P. Carrier

(57) ABSTRACT

In a general-purpose internal combustion engine having a throttle valve and a choke valve each installed in an air intake passage connected to a combustion chamber, air sucked in flowing through the air intake passage and mixing with fuel supplied by a carburetor to generate an air-fuel mixture that enters the combustion chamber of a cylinder and is ignited to drive a piston to rotate a crankshaft to be connected to a load such as a generator, there are provided an electric motor (actuator), a throttle valve opening/closing mechanism connected to the motor to open/close the throttle valve and a choke valve opening/closing mechanism connected to the throttle valve opening/closing mechanism to open/close the choke valve in response to operation of the throttle valve opening/closing mechanism, thereby enabling to move a choke valve without need to install an additional actuator.

17 Claims, 14 Drawing Sheets

U.S. PATENT DOCUMENTS

| | | | | |
|---|---|---|---|---|
| 7,144,000 | B2 * | 12/2006 | Roth et al. | 261/39.3 |
| 7,156,376 | B2 * | 1/2007 | Bungo et al. | 261/64.1 |
| 7,204,232 | B2 * | 4/2007 | Matsuda | 123/438 |
| 7,284,522 | B2 * | 10/2007 | Kamimura et al. | 123/179.18 |
| 7,331,326 | B2 * | 2/2008 | Arai et al. | 123/361 |
| 7,344,125 | B2 * | 3/2008 | Matsuda et al. | 261/64.1 |
| 7,431,271 | B2 * | 10/2008 | Gantert et al. | 261/52 |
| 7,461,631 | B2 * | 12/2008 | Ohtsuji | 123/400 |
| 7,503,292 | B2 * | 3/2009 | Holmdahl | 123/73 PP |
| 2006/0266330 | A1 * | 11/2006 | Fukushima et al. | 123/399 |
| 2007/0012287 | A1 | 1/2007 | Shinogi et al. | |
| 2009/0271097 | A1 * | 10/2009 | Kasai et al. | 701/113 |

FOREIGN PATENT DOCUMENTS

| | | |
|---|---|---|
| JP | 62-223447 | * 10/1987 |
| JP | 2006-77706 | * 3/2006 |
| JP | 2007-023838 (A) | 2/2007 |
| JP | 2009-264265 | * 11/2009 |

* cited by examiner

GENERAL PURPOSE INTERNAL COMBUSTION ENGINE

BACKGROUND OF THE INVENTION

1. Field of the Invention

This invention relates to a general-purpose internal combustion engine, particularly to a general-purpose internal combustion engine equipped with an actuator for driving a throttle valve.

2. Description of the Related Art

Conventionally, electronically-controlled throttle apparatuses (electronically-controlled governors) utilizing an actuator such as a stepper motor to open and close a throttle valve for accurately controlling engine speed have been applied to general-purpose internal combustion engines used as prime movers in generators, agricultural machines and various other equipment.

In recent years, there is proposed a technique for improving engine starting performance by employing an automatic choke apparatus that uses an actuator to open and close a choke valve of a general-purpose engine so as to close the choke valve at cold start or the like for producing a rich air-fuel mixture. When the automatic choke apparatus is applied to the above-mentioned engine, in addition to the actuator for the throttle valve, the engine will need another actuator for the choke valve, as taught, for example, by Japanese Laid-Open Patent Application No. 2007-23838 (paragraphs 0022, 0036, FIG. 2, etc.).

However, the additional installation of an actuator for the choke valve as set forth in the prior art requires an extra space for the installment of the actuator and the like, disadvantageously increasing the size of the entire engine.

SUMMARY OF THE INVENTION

An object of this invention is therefore to overcome this problem by providing a general-purpose internal combustion engine having a choke valve opening/closing mechanism that can move a choke valve without need to install an additional actuator.

In order to achieve the object, this invention provides a general-purpose internal combustion engine having a throttle valve and a choke valve each installed in an air intake passage connected to a combustion chamber, air sucked in flowing through the air intake passage and mixing with fuel to generate an air-fuel mixture that enters the combustion chamber of a cylinder and is ignited to drive a piston to rotate a crankshaft to be connected to a load, comprising: an actuator; a throttle valve opening/closing mechanism connected to the actuator to open/close the throttle valve; and a choke valve opening/closing mechanism connected to the throttle valve opening/closing mechanism to open/close the choke valve in response to operation of the throttle valve opening/closing mechanism.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

A general-purpose internal combustion engine according to preferred embodiments of the present invention will now be explained with reference to the attached drawings.

Figure 1:
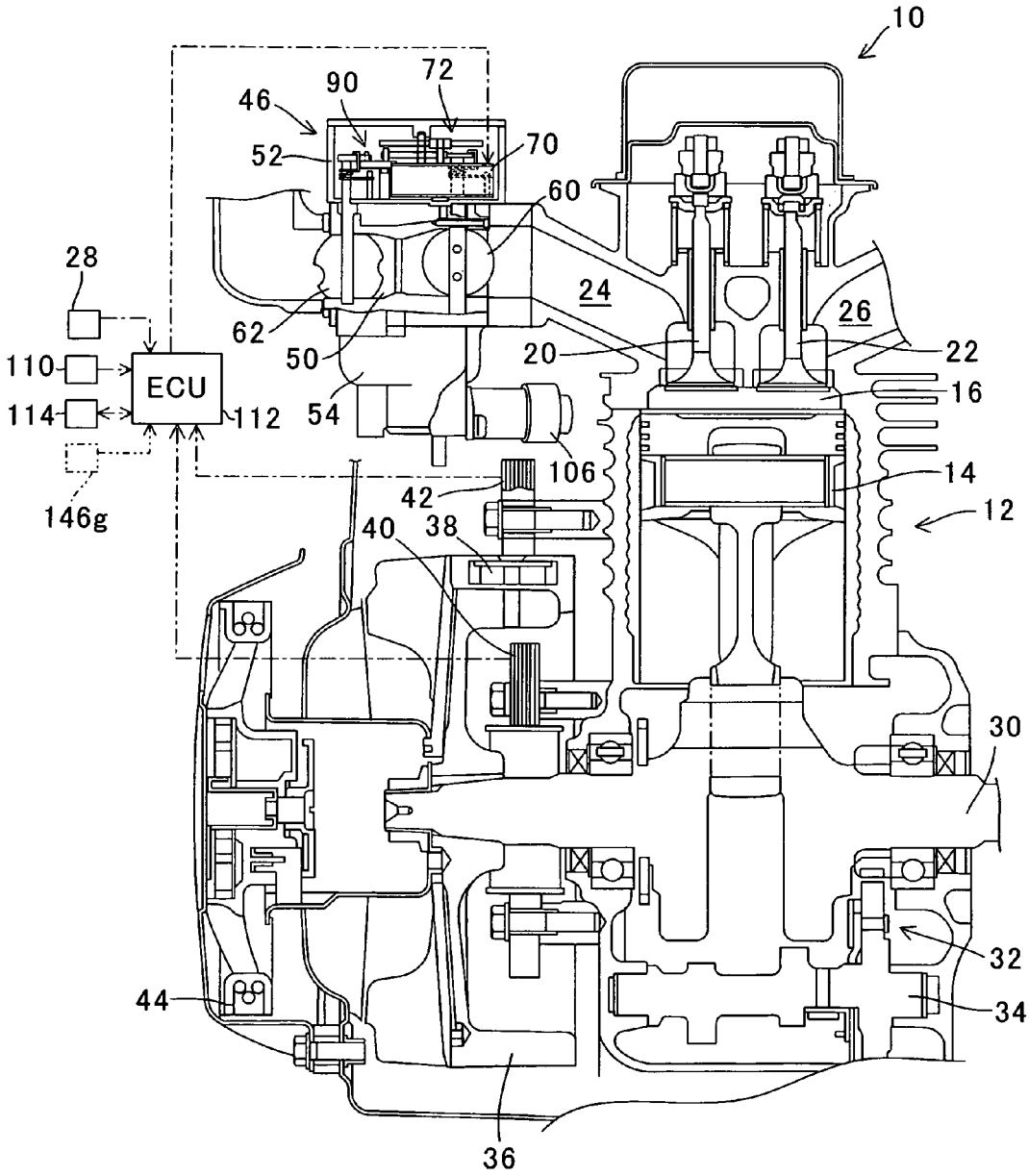
FIG. 1 is an overall view of a general-purpose internal combustion engine according to a first embodiment of this invention.

FIG. 1 is an overall view of a general-purpose internal combustion engine according to a first embodiment.

Reference numeral 10 in FIG. 1 designates a general-purpose internal combustion engine (hereinafter simply called "engine"). The engine 10 is an air-cooled, four-cycle, single-cylinder OHV model with a displacement of, for example, 440 cc. The engine 10 is suitable for use as the prime mover of a generator, agricultural machine or any of various other kinds of equipment.

The engine 10 has a cylinder 12 accommodating a piston 14 that can reciprocate therein. An intake valve 20 and exhaust valve 22 are installed so as to face a combustion chamber 16 of the engine 10 for opening and closing communication between the combustion chamber 16 and an intake port 24 or exhaust port 26. A temperature sensor 28 is disposed near the cylinder 12 for producing an output indicating the temperature of the engine 10.

The piston 14 is connected to a crankshaft 30 that is connected to a camshaft 34 through a gear mechanism 32 for the camshaft 34. One end of the crankshaft 30 is connected with a load (not shown) such as a generator and the other end thereof with a flywheel 36.

The flywheel 36 is installed with magnet pieces 38 on its inside surface. Also on the inside of the flywheel 36, a power coil (generation coil) 40 and a fuel-cut solenoid valve coil (FS coil; shown in FIG. 4 which will be described later) are fastened to the engine body to face the magnet pieces 38 and on the outside of the flywheel 36, a pulsar coil 42 is fastened to the engine body to face the magnet pieces 38. The power coil 40, pulsar coil 42 and FS coil produce outputs, i.e., alternating current synchronous with rotation of the crankshaft 30. The crankshaft 30 is attached with a recoil starter 44 that starts the engine 10 when manually manipulated or operated by the operator.

A carburetor 46 is connected to the intake port 24.

Figure 2:
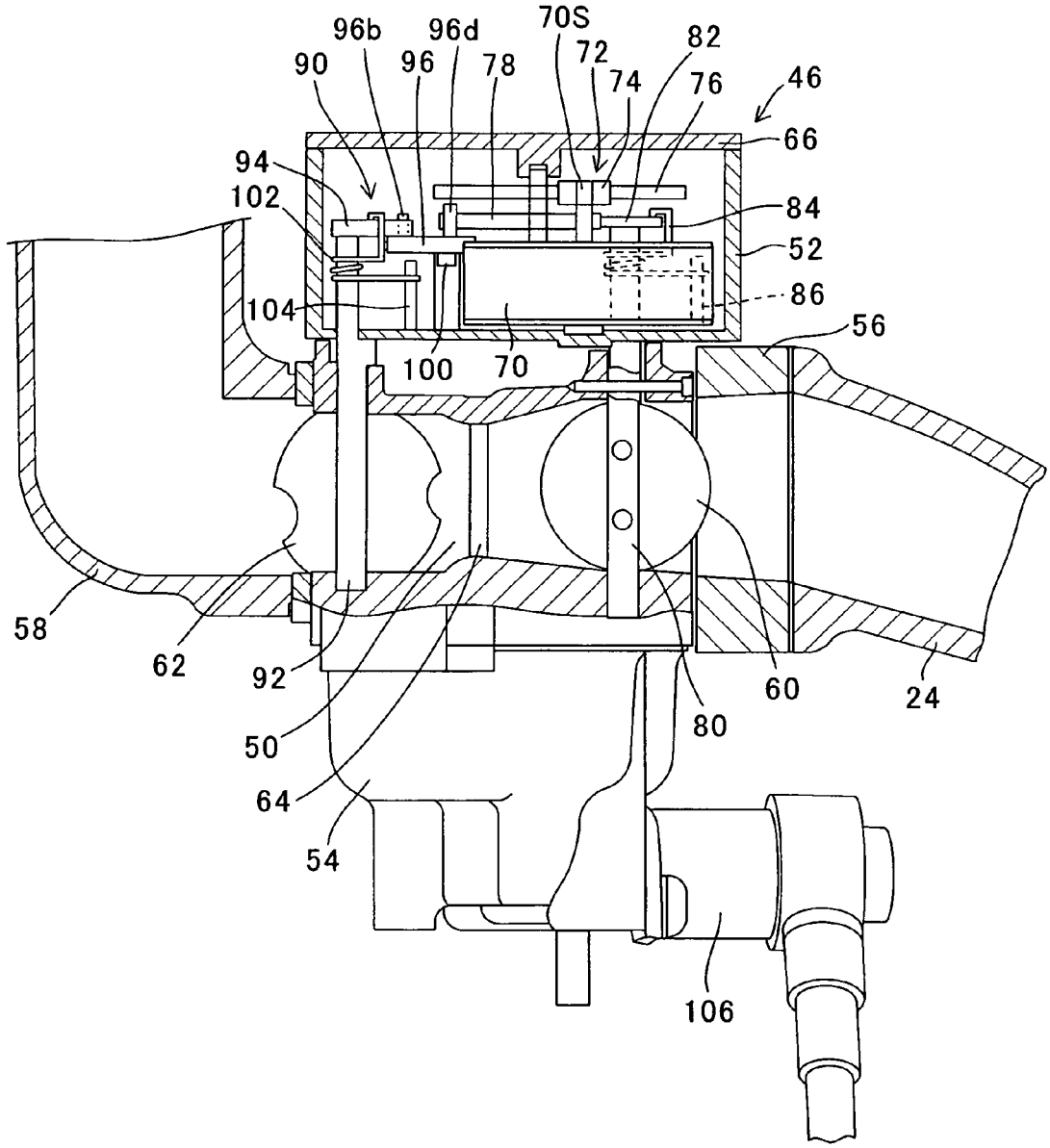
FIG. 2 is an enlarged cross-sectional view of a carburetor shown in FIG. 1.

FIG. 2 is an enlarged cross-sectional view of the carburetor 46 shown in FIG. 1.

As shown in FIG. 2, the carburetor 46 unitarily comprises an air intake passage 50, motor case 52 and carburetor assembly 54. The downstream side of the air intake passage 50 is connected through an insulator 56 to the intake port 24, and the upstream side thereof is connected through an air-cleaner elbow 58 to an air-cleaner (not shown). A throttle valve 60 is installed in the air intake passage 50 and a choke valve 62 is also installed in the air intake passage 50 on the upstream side of the throttle valve 60. The air intake passage 50 is reduced in diameter between the throttle valve 60 and choke valve 62 to form a venturi 64.

The motor case 52 is attached with a cover 66 and the internal space formed by the motor case 52 and cover 66 is disposed with an electric motor (actuator) 70 for driving the throttle valve 60 and choke valve 62. Specifically, the motor 70 is a stepper motor having a rotor and a stator wound with a coil and connected to the throttle valve 60 via a throttle valve opening/closing mechanism (gear mechanism) 72.

Figure 3:
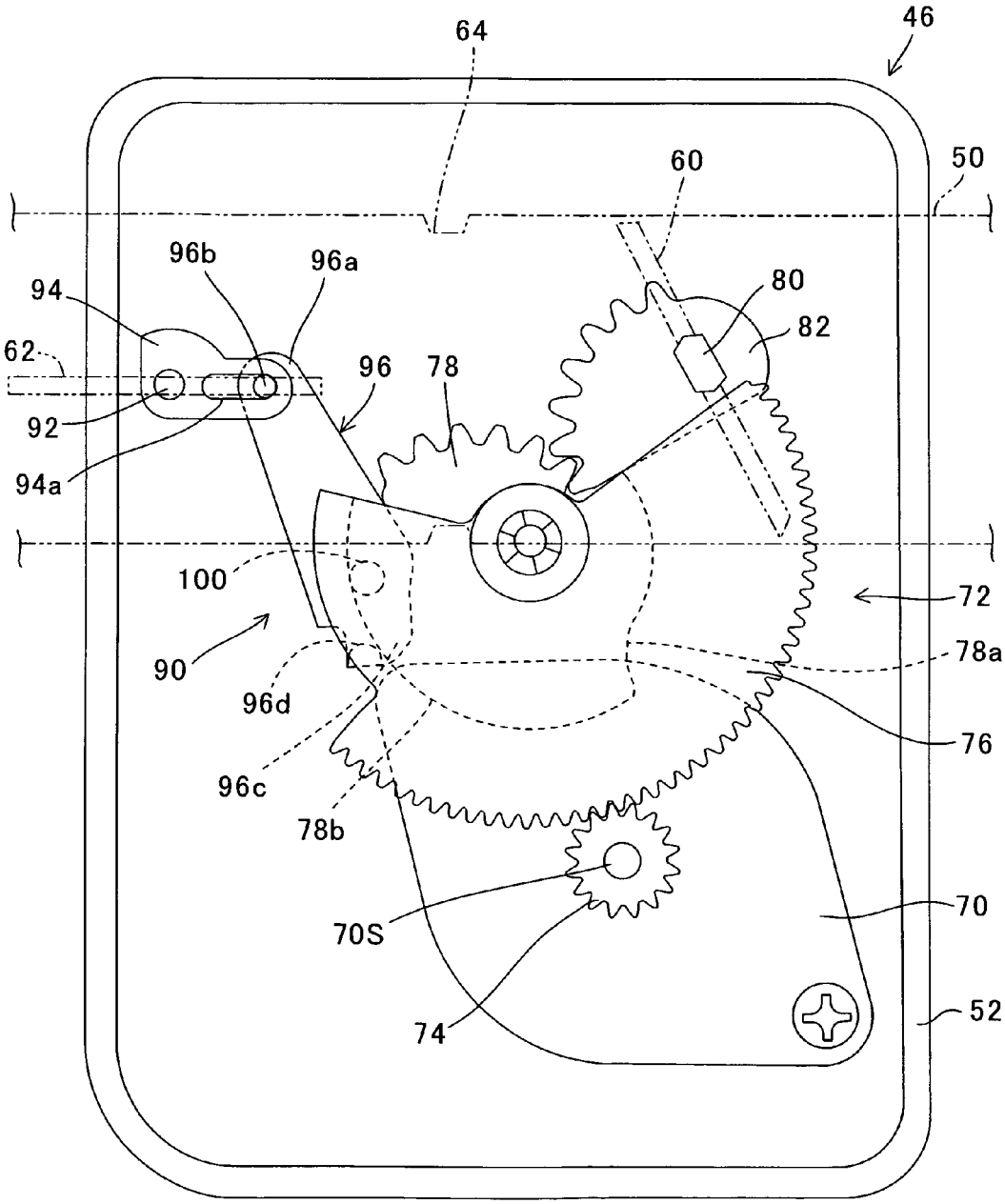
FIG. 3 is a plan view of the carburetor shown in FIG. 2 when a cover of a motor case is removed.

FIG. 3 is a plan view of the carburetor 46 shown in FIG. 2 when the cover 66 of the motor case 52 is removed. FIG. 3 shows the status where the throttle valve 60 is at the fully-closed position and the choke valve 62 is at the fully-opened position, as indicated by imaginary lines.

As shown in FIGS. 2 and 3, the throttle valve opening/closing mechanism 72 includes four gears that are all external gears. Specifically, an output shaft 70S of the motor 70 is attached with a first gear 74 and the first gear 74 is engaged with a second gear 76 which is rotatably supported in the motor case 52. A third gear (eccentric gear) 78 is installed coaxially with the second gear 76 to be integrally rotatable therewith. As can be seen in FIG. 3, the third gear 78 is formed with teeth only on a part of its circumference (where a fourth gear (explained later) is to be engaged).

The third gear 78 is engaged with the fourth gear (eccentric gear; now assigned by 82) connected to a throttle shaft 80 that supports the throttle valve 60. With this configuration, the output of the motor 70 is reduced in speed in accordance with gear ratios of the gears 74, 76, 78, 82 and transmitted to the throttle shaft 80 to open and close the throttle valve 60. One of the characteristics of this embodiment is that the mechanism 72 is configured to open and close the throttle valve 60 within a range between the fully-closed position and a position over or beyond the fully-opened position by predetermined opening, i.e., a position set over the fully-opened position in the opening direction by the predetermined opening, in response to the operation of the motor 70. This will be explained later.

The throttle shaft 80 is installed on its circumference with a throttle return spring 84 (shown in FIG. 2) that is constituted of a torsion coil spring. One end of the spring 84 is connected to the fourth gear 82 attached to the throttle shaft 80 and the other end thereof is connected to a hook pin 86 (shown in FIG. 2) projected in the motor case 52. Winding of the spring 84 is set in the direction in which the throttle valve 60 is opened via the throttle shaft 80.

The throttle valve opening/closing mechanism 72 is connected with the choke valve 62 through a choke valve opening/closing mechanism 90. Therefore, the motor 70 is connected to the throttle valve 60 through the mechanism 72 and to the choke valve 62 through the mechanisms 72, 90.

The choke valve opening/closing mechanism 90 comprises an arm 94 that is attached to a choke shaft 92 supporting the choke valve 62 for rotating the shaft 92, and a link 96 that connects the arm 94 with the mechanism 72 (precisely, the third gear 78 thereof).

The link 96 is supported to be rotatable about a rotation shaft 100 in the motor case 52. The link 96 is provided at its end (one end) 96*a* on the arm 94 side with a first pin 96*b* that extends upward in FIG. 2. The first pin 96*b* is inserted through a long hole 94*a* bored in the arm 94.

The link 96 is also provided at its end (the other end) 96*c* on the third gear 78 side with a second pin 96*d* that extends upward in FIG. 2. The second pin 96*d* abuts on the circumference of the third gear 78 at a portion not formed with teeth. The portion of the circumference of the third gear 78 where no teeth is formed (i.e., where the second pin 96*d* abuts) has a substantially disk shape and has a concavity. The portion of the circumference of the third gear 78 where the concavity is formed is called the "first abutment portion" and assigned by 78*a*. The remaining portion of the circumference of the third gear 78 where no teeth is formed other than the first abutment portion 78*a* is called the "second abutment portion" and assigned by 78*b*. Positions formed with the first and second abutment portions 78*a*, 78*b* on the circumference of the third gear 78 will be described later.

As shown in FIG. 2, a choke return spring 102 is installed on the circumference of the choke shaft 92. The spring 102 is constituted of a torsion coil spring, similarly to the throttle return spring 84. One end of the choke return spring 102 is connected to the arm 94 and the other end thereof to a hook pin 104 that projects in the motor case 52. Winding of the spring 102 is set in the direction in which the choke valve 62 is closed via the choke shaft 92.

Since the choke valve opening/closing mechanism 90 is configured to include the spring 102 that urges the choke valve 62 in the closing direction (toward the fully-closed position), the urging force is transmitted to the link 96 through the arm 94. As a result, counterclockwise force about the rotation shaft 100 acts on the link 96 so that the second pin 96*d* of the link 96 constantly abuts, as being pressed, on the circumference (i.e., the first or second abutment portion 78*a*, 78*b*) of the third gear 78.

Thus the one end 96*a* of the link 96 is connected to the choke shaft 92 through the first pin 96*b* and arm 94, and the other end 96*c* thereof to (abuts on) the throttle valve opening/closing mechanism 72 (precisely, the first or second abutment portion 78*a*, 78*b* of the third gear 78) through the second pin 96*d*.

Although not shown in the drawing, the carburetor assembly 54 comprises a float chamber connected to a fuel tank, a main nozzle connected to the float chamber through a main jet and main fuel passage, and an idle port and a slow port both connected to a slow fuel passage that is branched from the main fuel passage. The main nozzle is installed at a position where it faces into the venturi 64 and the idle port and slow port are installed at positions where they face into the vicinity of the throttle valve 60.

When the opening of the throttle valve 60 is large, fuel is injected from the main nozzle owing to the negative pressure of the intake air passing through the venturi 64, thereby producing an air-fuel mixture. On the other hand, when the opening of the throttle valve 60 is small, fuel is injected from the idle port or slow port owing to the negative pressure of the intake air passing through the throttle valve 60. When the choke valve 62 is closed, the negative pressure in the air intake passage 50 generated by descending stroke of the piston 14 is increased, thereby increasing an amount of injected fuel and producing an enriched air-fuel mixture. The condition where the air-fuel mixture in the air intake passage 50 is enriched is hereinafter called the "rich air-fuel mixture condition."

The reference numeral 106 in FIG. 2 designates a fuel-cut solenoid valve (FS valve). A valve member (not shown) of the FS valve 106 is disposed between the float chamber and main jet and, when a coil (shown in FIG. 4; explained later) is energized, is closed for blocking passage of fuel.

Returning to the explanation of FIG. 1, the air-fuel mixture thus produced passes through the intake port 24 and intake valve 20 to be sucked into the combustion chamber 16. The sucked air-fuel mixture is ignited by an spark plug (shown in FIG. 4; explained later) to burn and the resulting combustion gas is discharged to the exterior of the engine 10 through the exhaust valve 22, exhaust port 26, a muffler (not shown) and the like.

Thus, the engine 10 has the throttle valve 60 and choke valve 62 each installed in the air intake passage 50 connected to the combustion chamber 16, and air sucked in flows through the air intake passage 60 and mixes with fuel supplied by the carburetor 46 to generate the air-fuel mixture that enters the combustion chamber 16 of the cylinder 12 and is ignited to drive the piston 14 to rotate the crankshaft 30 to be connected to a load such as a generator.

An engine speed setting switch 110 is installed to be manipulated by the operator and produces an output or signal indicative of desired engine speed in response to the manipulation by the operator. The outputs of the above-mentioned temperature sensor 28, power coil 40, pulsar coil 42 and the engine speed setting switch 110 are sent to an electronic control unit (ECU) 112 that is constituted as a microcomputer.

A combination switch 114 is also installed to be manipulated by the operator. The combination switch 114 is connected to the ECU 112. Based on the operator's manipulation of the combination switch 114 and the other inputs, the ECU 112 controls the operation of the engine 10 (e.g., the operation of the electric motor 70).

Figure 4:
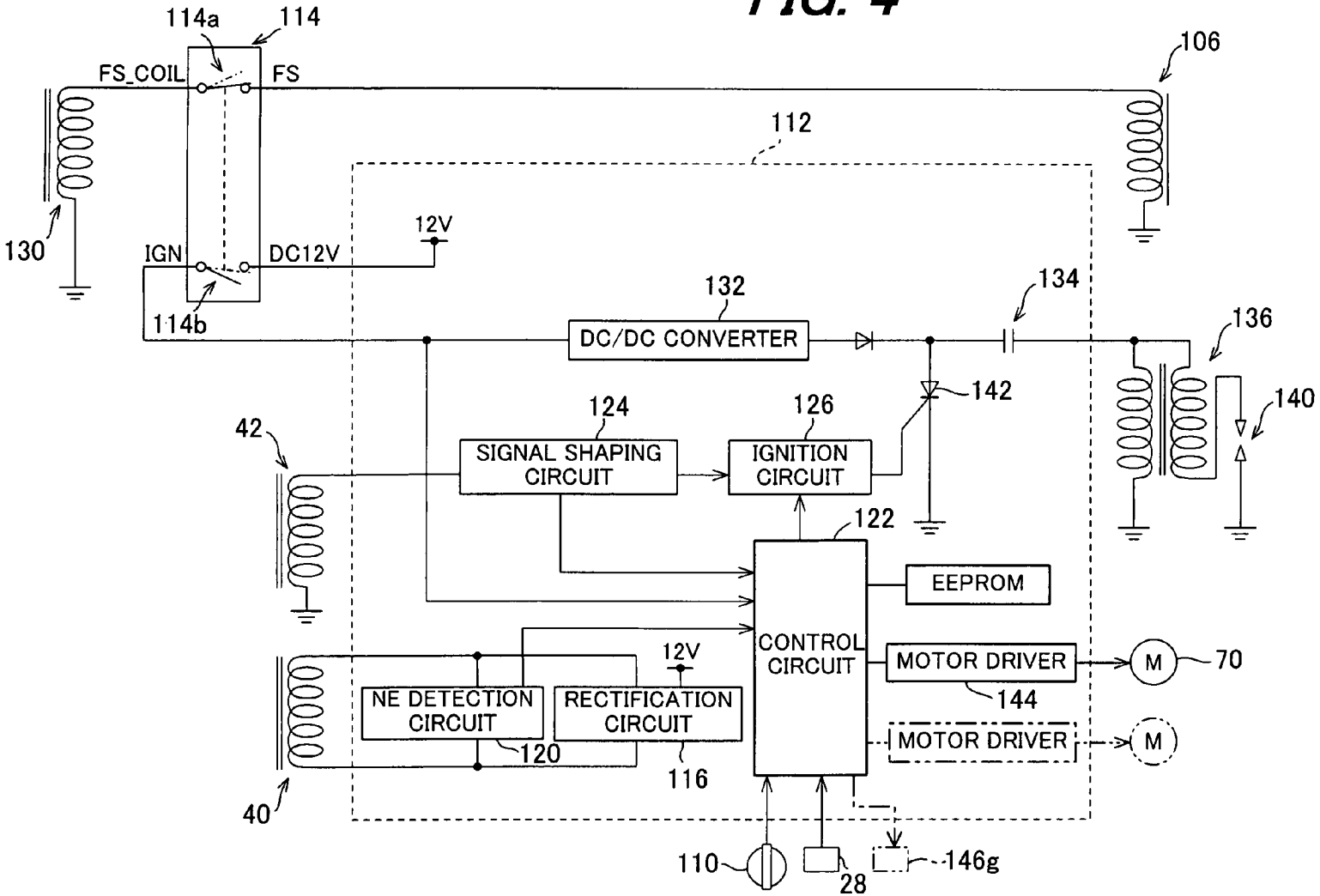
FIG. 4 is an explanatory view showing the configuration of an electronic control unit and combination switch shown in FIG. 1.

FIG. 4 is an explanatory view showing the configuration of the ECU 112 and the combination switch 114.

As shown in FIG. 4, the ECU 112 is equipped with a rectification circuit 116, engine speed (NE) detection circuit 120 and control circuit 122. The output of the power coil 40 is inputted to the rectification circuit 116, where it is converted to 12V direct current to be supplied as operating power to the components of the engine 10, such as the ECU 112, through a circuit (not shown). The output of the power coil 40 is also sent to the engine speed detection circuit 120, where it is converted to a pulse signal. The pulse signal is inputted to the control circuit 122 for detecting the engine speed. The ECU 112 is further equipped with a signal shaping circuit 124 and an ignition circuit 126. The output of the pulsar coil 42 is inputted to the signal shaping circuit 124, where it is formed as the ignition signal synchronous with rotation of the crankshaft 30 and then sent to the ignition circuit 126 and control circuit 122.

The combination switch 114 comprises first and second switches 114*a*, 114*b*. In FIG. 4, the solid lines indicate the state of the switches 114*a*, 114*b* when the combination switch 114 is in the OFF position and the imaginary lines indicate their state when it is in the ON position.

The first switch 114*a* is interposed between the FS coil (now assigned by 130) and the FS valve (precisely, the valve thereof) 106. When the second switch 114*b* is turned ON, the 12V direct current generated from the output of the power coil 40 is inputted to the control circuit 122 and a DC/DC converter 132. The DC/DC converter 132 is connected to the primary coil of an ignition coil 136 through a capacitor 134 for charging the capacitor 134. The secondary coil of the ignition coil 136 is connected to the spark plug (now assigned by 140) and the capacitor 134 is grounded via a thyristor 142.

The ignition circuit 126 applies current to the gate of the thyristor 142 in response to an ignition signal from the signal shaping circuit 124 or control circuit 122, so that the capacitor 134 discharges to energize the primary coil of the ignition coil 136. The resulting high voltage generated in the secondary coil produces spark between electrodes of the spark plug 140, thereby igniting the air-fuel mixture in the combustion chamber 16.

The above-mentioned temperature sensor 28 and engine speed setting switch 110 are connected to the control circuit 122. Based on the outputs of the temperature sensor 28, engine speed setting switch 110, engine speed detection circuit 120 and the like, the control circuit 122 determines desired openings of the throttle valve 60 and choke valve 62 and outputs control signals in accordance with the determined desired openings to a motor driver 144 so as to operate the motor 70, thereby opening and closing the valves 60, 62 to regulate the engine speed or fuel quantity to be supplied to the engine 10.

When the combination switch 114 is put in the ON position by the operator, the first switch 114*a* is turned OFF to cut off the supply of operating current to the FS valve 106. The FS valve 106 is normally open, so that cutting off the supply of operating current enables jetting of fuel from the carburetor 46. On the other hand, when the second switch 114*b* is turned ON and the recoil starter 44 is operated, the resulting rotation of the crankshaft 30 causes the power coil 40 and pulsar coil 42 to produce outputs. As a result, 12V direct current and an ignition signal are produced (shaped) to activate the ECU 112 and start the engine 10.

When the combination switch 114 is put in the OFF position, the second switch 114*b* is turned OFF and the supply of operating current to the control circuit 122 is cut off, whereby the control circuit 122 terminates ignition to stop the engine 10, and the first switch 114*a* is turned ON to interconnect the FS coil 130 and the FS valve 106, thereby performing fuel cutoff. In other words, since rotation of the crankshaft 30 does not stop immediately after ignition is terminated, the FS coil 130 continues to generate electricity and accordingly the FS valve 106 receives operating current from the FS coil 130 and is closed (i.e., fuel cutoff is performed) for a certain period.

Next, the opening and closing operation of the throttle valve 60 and choke valve 62 will be explained with focus on the operation of the motor 70, throttle valve opening/closing mechanism 72 and choke valve opening/closing mechanism 90 with reference to FIGS. 3 and 5 onward.

FIG. 5 is an explanatory view showing the characteristics of the opening and closing operation of the throttle valve 60 and choke valve 62.

Figure 5A:
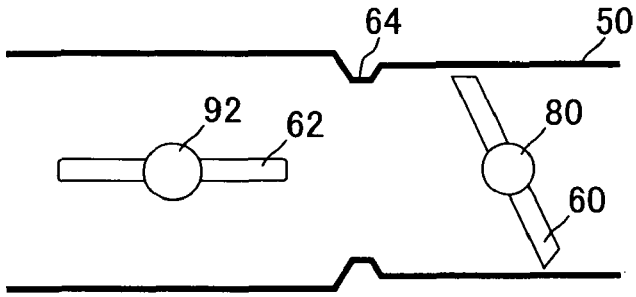
FIG. 5 is an explanatory view showing the characteristics of opening and closing operation of a throttle valve and choke valve shown in FIG. 1 etc.

In order to operate the throttle valve 60 to the fully-closed position, the motor 70 rotates the throttle shaft 80 through the first to fourth gears 74, 76, 78, 82 of the mechanism 72 so as to close the throttle valve 60 to the fully-closed position shown in FIGS. 3 and 5A. As can be seen in FIG. 3, at this time, the second pin 96*d* of the link 96 abuts on the second abutment portion 78*b* of the third gear 78 and the choke valve 62 is fully opened.

Figure 5B:
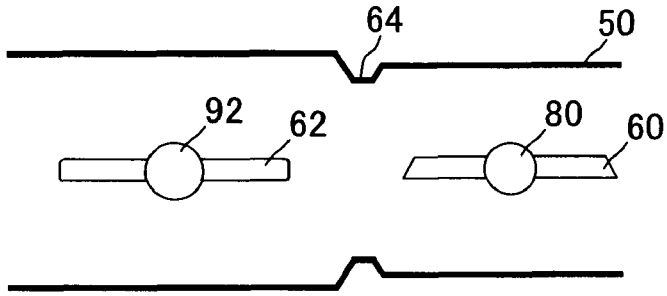
Figure 6:
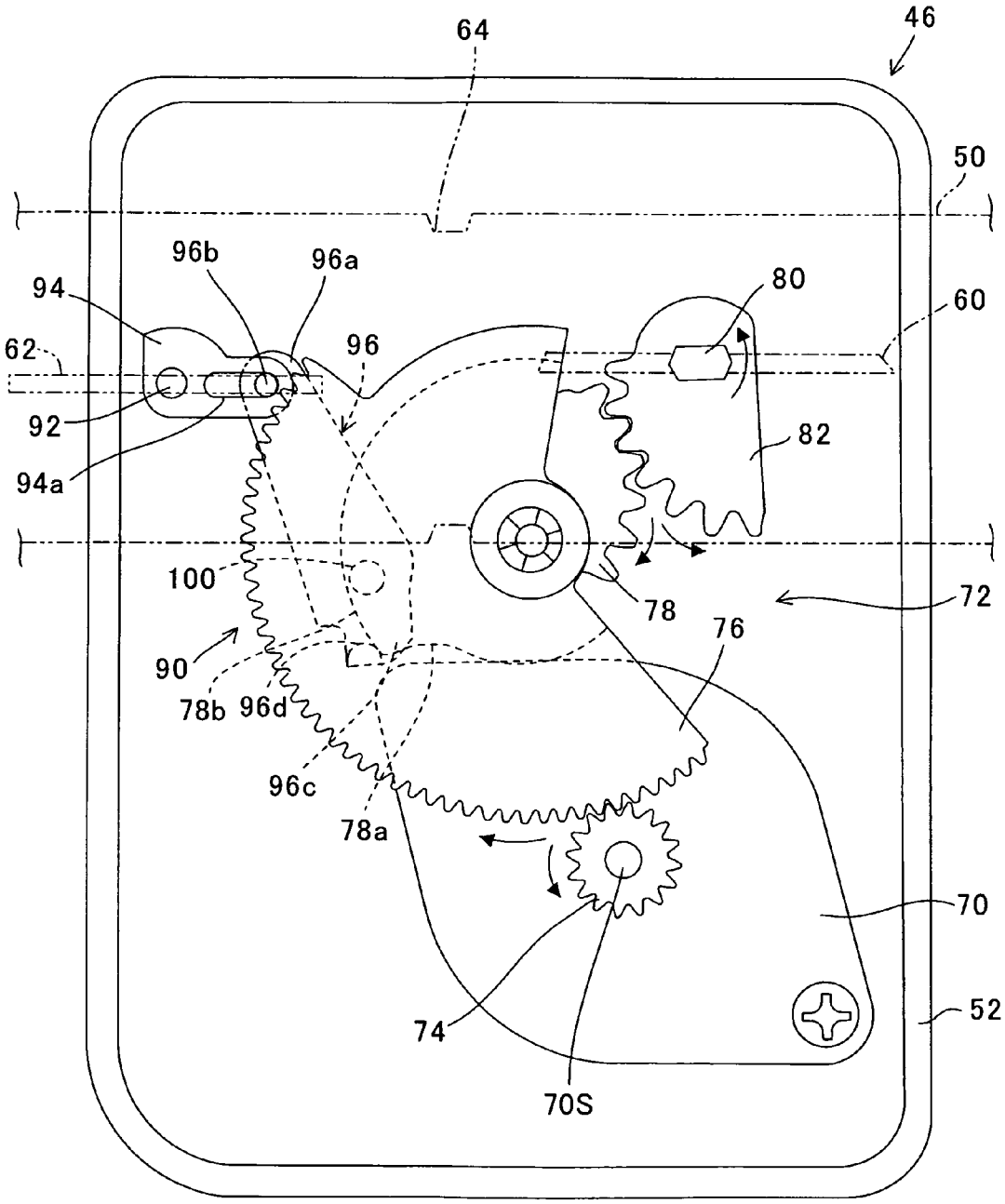
FIG. 6 is a view, similar to FIG. 3, showing the carburetor shown in FIG. 2.

In order to operate the throttle valve 60 from the fully-closed position to the fully-opened position, the motor 70 operates the first to fourth gears 74, 76, 78, 82 to rotate in the directions indicated by arrows in FIG. 6 to rotate the throttle shaft 80 counterclockwise, thereby opening the throttle valve 60 to the fully-opened position. At this time, since the second pin 96*d*, while sliding to a position near the first abutment portion 78*a*, remains abutting on the second abutment portion 78*b*, as can be seen in FIG. 5B, the choke valve 62 is held at the fully-opened position. Thus, when the throttle valve 60 is positioned between the fully-closed position and the fully-opened position, the mechanism 90 holds the choke valve 62 at the fully-opened position.

When the choke valve 62 is closed for producing the rich air-fuel mixture at engine start or the like, the motor 70 operates the mechanism 72 to displace the link 96 which moves in response thereto and rotate the choke shaft 92, thereby opening and closing the choke valve 62. Specifically, the motor 70 operates the first to fourth gears 74, 76, 78, 82 to rotate in the directions indicated by arrows in FIG. 7 to further rotate the throttle shaft 80 counterclockwise, thereby opening the throttle valve 60 to a position over or beyond the fully-opened position by predetermined opening a, which position is hereinafter called the "over-fully-opened position."

At this time, the second pin 96*d* slides to the first abutment portion 78*a* by the rotation of the third gear 78. It causes the link 96 to displace or rotate about the rotation shaft 100 in the counterclockwise direction, so that the first pin 96*b*, while sliding in the long hole 94*a*, displaces the arm 94. The displacement of the arm 94 makes the choke shaft 92 rotate clockwise in the drawing, thereby closing the choke valve 62 to the fully-closed position as shown in FIG. 5C.

Figure 7:
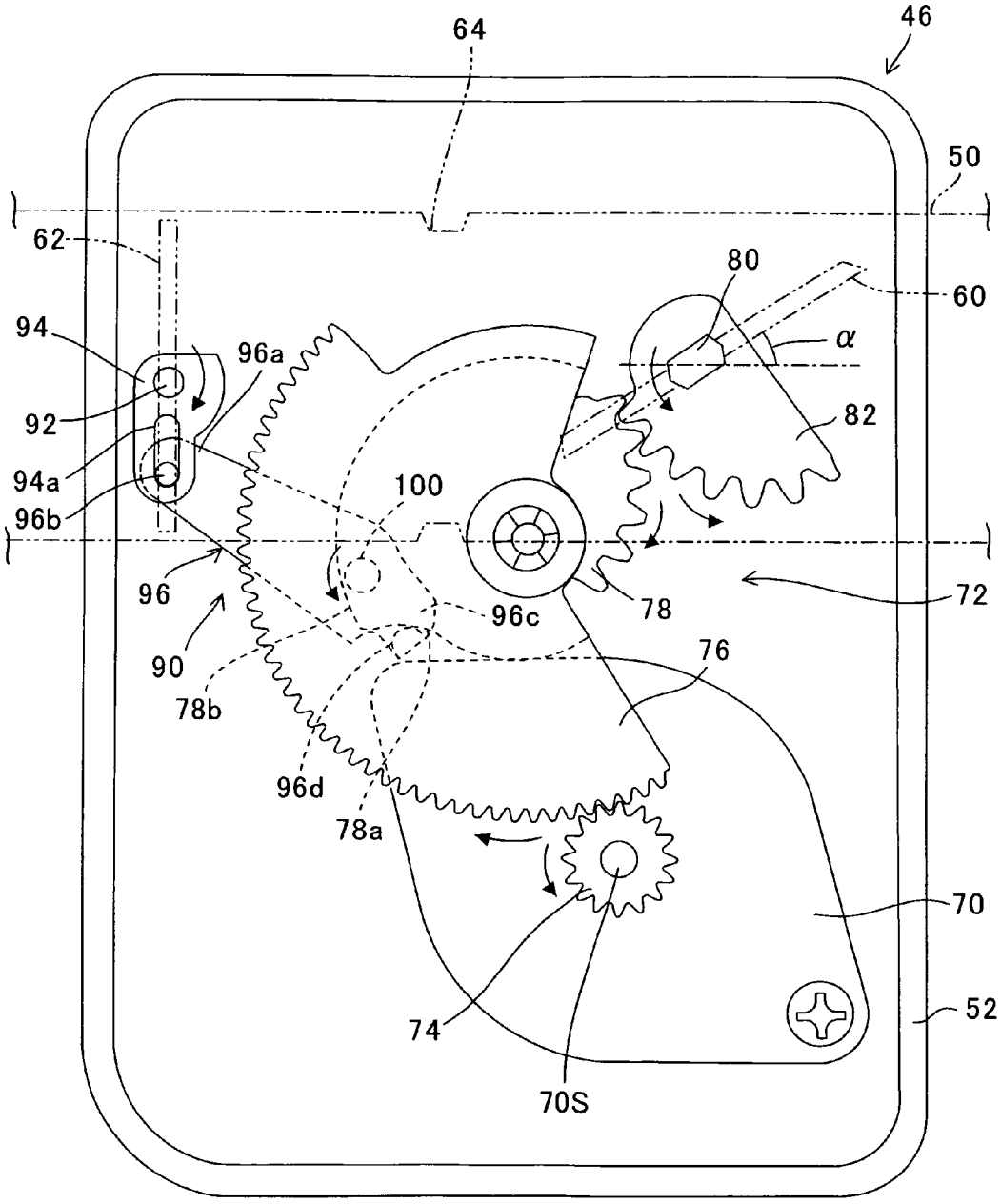
FIG. 7 is a view, similar to FIG. 3, showing the carburetor shown in FIG. 2.

Thus, the locations in the third gear 78 formed with the first and second abutment portions 78*a*, 78*b* are determined such that, when the second pin 96*d* abuts on the second abutment portion 78*b* (as shown, for example, in FIGS. 3 and 6), the choke valve 62 is positioned at the fully-opened position, while the third gear 78 is rotated clockwise in the drawing by the motor 70, and when the second pin 96*d* abuts on the first abutment portion 78*a* (as shown in FIG. 7, for example), the choke valve 62 is positioned at the fully-closed position.

Figure 5C:
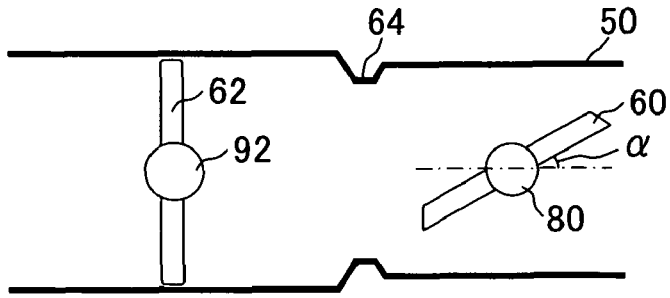

As shown in FIGS. 5A to 5C, the choke valve opening/closing mechanism 90 opens and closes the choke valve 62 in response to the movement of the throttle valve opening/closing mechanism 72. More specifically, when the throttle valve 60 is positioned between the fully-closed position and the fully-opened position, the mechanism 90 holds the choke valve 62 at the fully-opened position, and when the throttle valve 60 is positioned between the fully-opened position and the over-fully-opened position, it opens and closes the choke valve 62 within a range between the fully-opened position and the fully-closed position.

In the foregoing, the movement of the choke valve 62 is explained using two kinds of positions, i.e., the fully-opened position and the fully-closed position. Since the first abutment portion 78*a* is formed in the concave shape, the choke valve 62 can be regulated to achieve a given opening by appropriately regulating a position where the second pin 96*d* abuts on the first abutment portion 78*a*. In other words, the choke valve 62 can be opened and closed between the fully-opened position and the fully-closed position by properly regulating the opening of the throttle valve 60 between the fully-opened position and the over-fully-opened position.

Next, the explanation will be made on the operation of the motor 70 of opening and closing the throttle valve 60 and choke valve 62 at starting of the engine 10.

Figure 8:
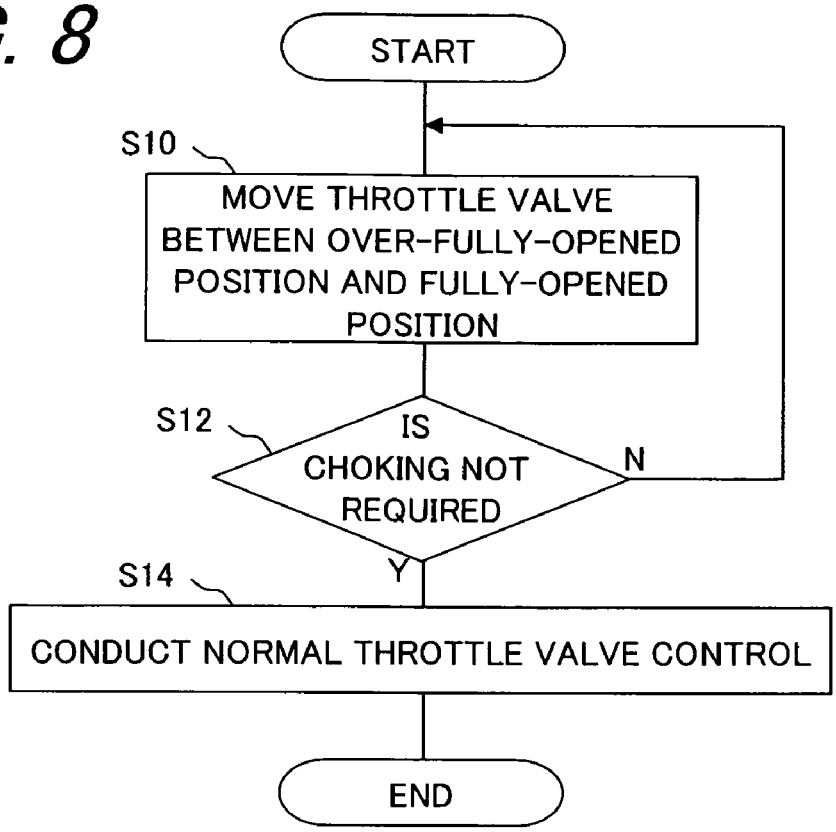
FIG. 8 is a flowchart showing the processing of controlling the operation of a throttle valve actuator at starting of the engine shown in FIG. 1.

FIG. 8 is a flowchart showing the processing of this operation of the motor 70 executed by the ECU 112.

The illustrated program is executed only once at engine start. The throttle valve 60 and choke valve 62 are positioned as shown in FIGS. 7 and 5C before the engine 10 is started, specifically the throttle valve 60 is at the over-fully-opened position due to the urging force by the throttle return spring 84 and the choke valve 62 is at the fully-closed position by the choke return spring 102.

When the combination switch 114 is put in the ON position and the recoil starter 44 is manipulated by the operator and successively the power coil 40 starts generating power to activate the ECU 112, the processing begins.

In S10, the operation of the motor 70 is controlled so as to move (open and close) the throttle valve 60 between the over-fully-opened position and the fully-opened position. The throttle valve 60 is moved as mentioned above to open and close the choke valve 62 between the fully-closed position and the fully-opened position, as shown in FIGS. 5B, 5C. As a result, the air-fuel mixture in the air intake passage 50 is made rich (i.e., the rich air-fuel mixture condition is established), thereby improving the starting performance of the engine 10.

In S12, it is determined whether choking is required, i.e., whether the warm-up operation has been completed and the rich air-fuel mixture condition should be terminated. The determination in S12 is made based on the output of the engine speed detection circuit 120 and, when the engine speed exceeds a predetermined value (e.g., 3000 rpm), it is discriminated that the choking is not required.

When the result in S12 is No, the program returns to S10 and when the result is Yes, the program proceeds to S14, in which the normal control of the throttle valve 60 is conducted to terminate the rich air-fuel mixture condition, which is produced by the choke valve 62. Specifically, the operation of the motor 70 is controlled so as to move the throttle valve 60 between the fully-closed position and the fully-opened position (i.e., move the throttle valve 60 at desired opening for maintaining the desired engine speed inputted through the engine speed setting switch 110). Since the throttle valve 60 is moved between the fully-closed position and the fully-opened position, as shown in FIGS. 5A, 5B, the choke valve 62 is held at the fully-opened position, thereby terminating the rich air-fuel mixture condition produced by the choke valve 62.

Next, the explanation will be made on the opening and closing operation of the throttle valve 60 and choke valve 62 when the engine 10 is stopped.

Figure 9:
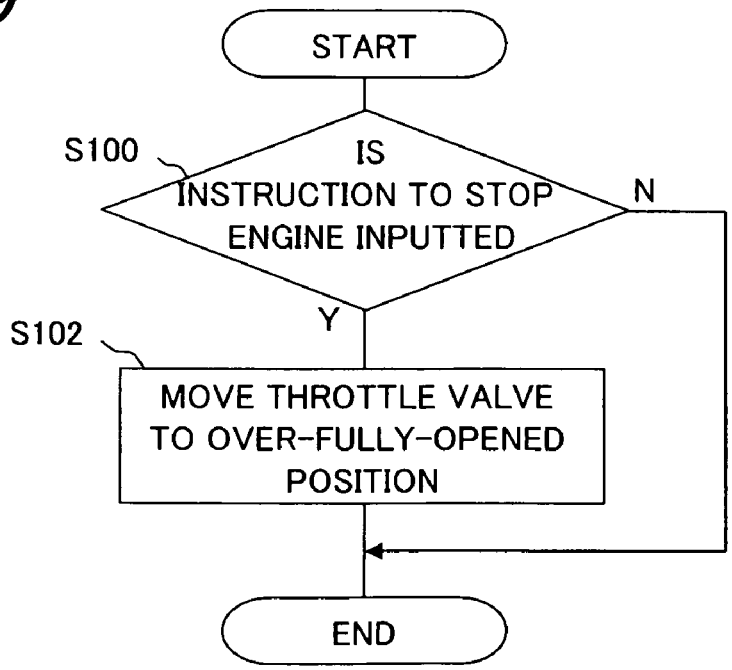
FIG. 9 is a flowchart showing the processing of controlling the operation of the throttle valve actuator when the engine shown in FIG. 1 is stopped.

FIG. 9 is a flowchart showing the processing of this operation of the motor 70 executed by the ECU 112. The illustrated program is executed at predetermined interval, e.g., 100 milliseconds.

In S100, it is determined whether an instruction to stop the engine 10 is inputted, specifically the combination switch 114 is put in the OFF position. When the result in S100 is No, the remaining steps are skipped and when the result is Yes, the program proceeds to S102, in which the operation of the motor 70 is controlled so that the throttle valve 60 is moved (opened) to the over-fully-opened position. The throttle valve 60 is thus moved to close the choke valve 62 to the fully-closed position, as shown in FIG. 5C, for preparing for the next engine start.

As described above, since the engine according to the first embodiment is thus configured, it becomes possible to move the choke valve 62 by the motor 70 adapted to move the throttle valve 60, i.e., move both the throttle valve 60 and the choke valve 62 solely by the motor 70. Owing to this configuration, the choke valve 62 can be moved without the need of another motor, saving space to be required for installment of another motor. Further, an electric motor for the choke valve, an associated motor driver (drive circuit), which are utilized in the prior art '838 and indicated by imaginary lines in FIG. 4, and other equipment such as a harness can be removed, thereby achieving decrease in power consumption and cost.

A general-purpose internal combustion engine according to a second embodiment of the invention will be explained.

Figure 10:
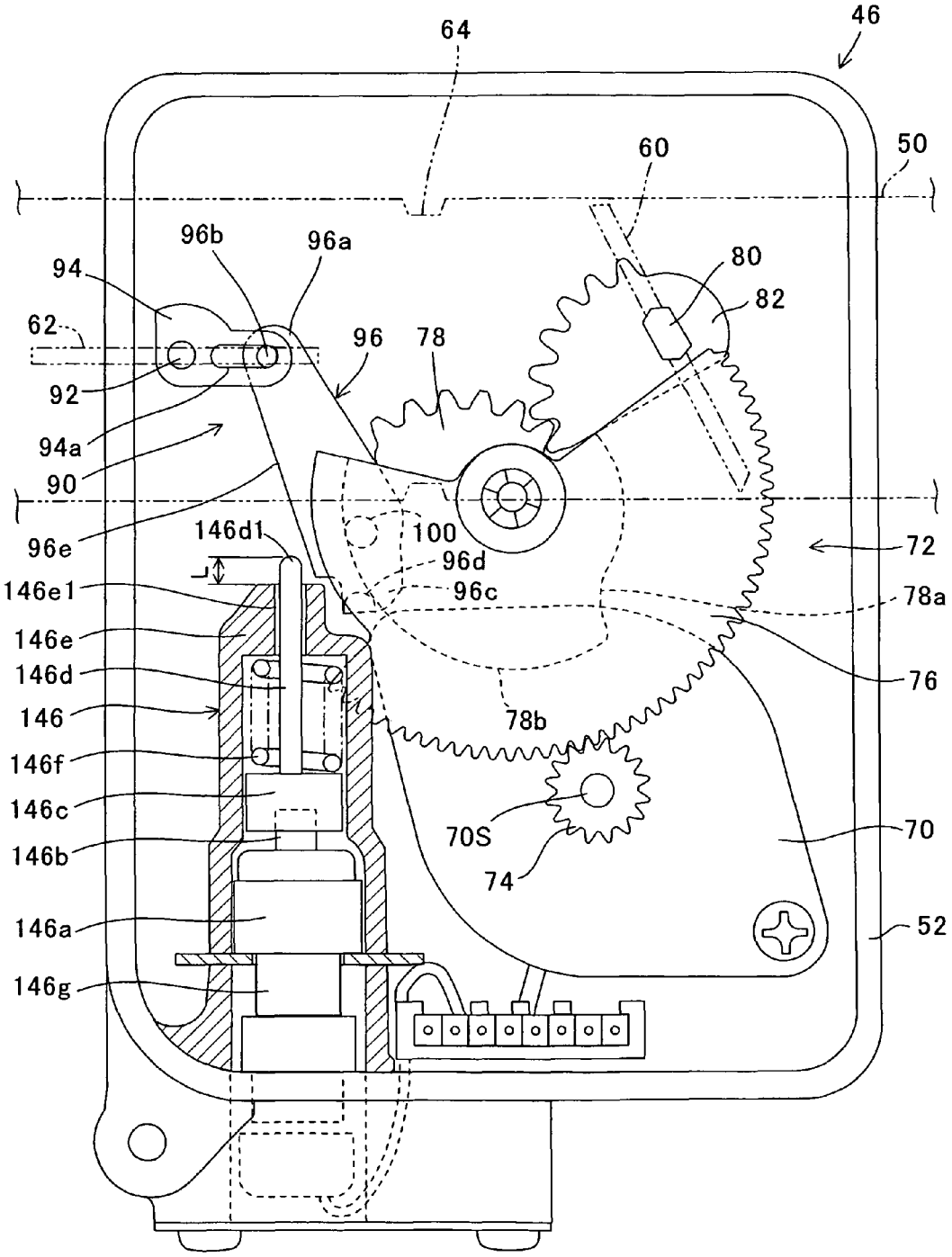
FIG. 10 is a plan view, similar to FIG. 3, but showing a carburetor of a general-purpose internal combustion engine according to a second embodiment of this invention.

FIG. 10 is a view, similar to FIG. 3, but showing a carburetor of the engine according to the second embodiment when the cover 66 of the motor case 52 is removed. Constituent elements corresponding to those of the first embodiment are assigned with the same reference symbols as those in the first embodiment and will not be explained.

The explanation will be made with focus on points of difference from the first embodiment.

In the second embodiment, as shown in FIG. 10, the motor case 52 is installed therein with a choke valve opening regulating mechanism 146 for regulating opening of the choke valve 62. The mechanism 146 comprises a thermo-wax having a wax section 146*a* filled with wax which expands and contracts in response to ambient temperature (precisely, wax which expands in its volume with increasing ambient temperature, while contracting with decreasing ambient temperature; not shown), a rod 146*b* which is connected to the wax section 146*a* and linearly displaces in response to the expansion/contraction of wax, a drive pin 146*d* which is connected to the wax section 146*a* through the rod 146*b* and a flange 146*c* and linearly displaces in response to the displace of the rod 146*b*, and a case 146*e* housing those components. FIG. 10 shows the mechanism 146 when the wax is contracted.

A tip 146*d*1 of the drive pin 146*d* projects toward the exterior through a hole 146*e*1 formed in the case 146*e* and can abut on the choke valve opening/closing mechanism 90 (i.e., the link 96 thereof, more precisely, a side surface 96*e* between the rotation shaft 100 and end 96*a*). The drive pin 146*d* is normally urged by a return spring 146*f* in the direction of housing the drive pin 146*d* in the case 146*e*, i.e., of shortening the projecting amount (length) L of the tip 146*d*1 (in the downward direction in the drawing). Therefore, the projecting amount L of the drive pin 146*d* is made minimum by the urging force of the return spring 146*f* when the wax is contracted (i.e., is not expanded) as shown in FIG. 10.

The mechanism 146 is further equipped with a heater 146*g* for heating the wax section 146*a*. Although not illustrated, the heater 146*g* is composed of a heating wire made of a nichrome wire etc., an insulating material covering the wire, a protection pipe and the like. The heater 146*g* is thus an electric heater that generates heat when being supplied with power current as operating power from the power coil 40. The operation of the heater 146*g* is controlled by the ECU 112 (i.e., the control circuit 122 thereof) as indicated by imaginary lines in FIGS. 1, 4.

The operation of the choke valve opening regulating mechanism 146 will be explained with reference to FIGS. 10 to 12.

Figure 11:
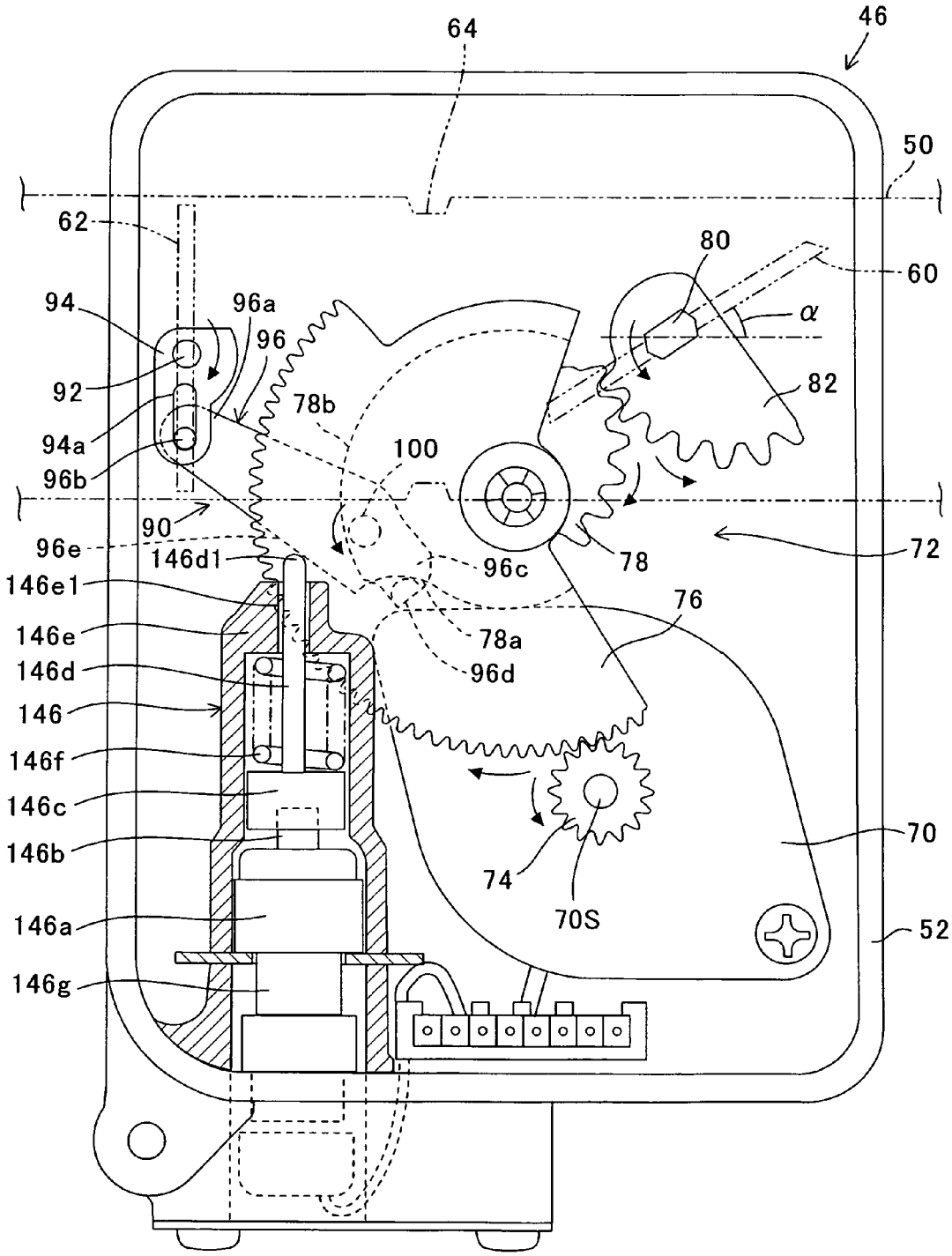
FIG. 11 is a view, similar to FIG. 10, showing the carburetor shown in FIG. 10.
Figure 12:
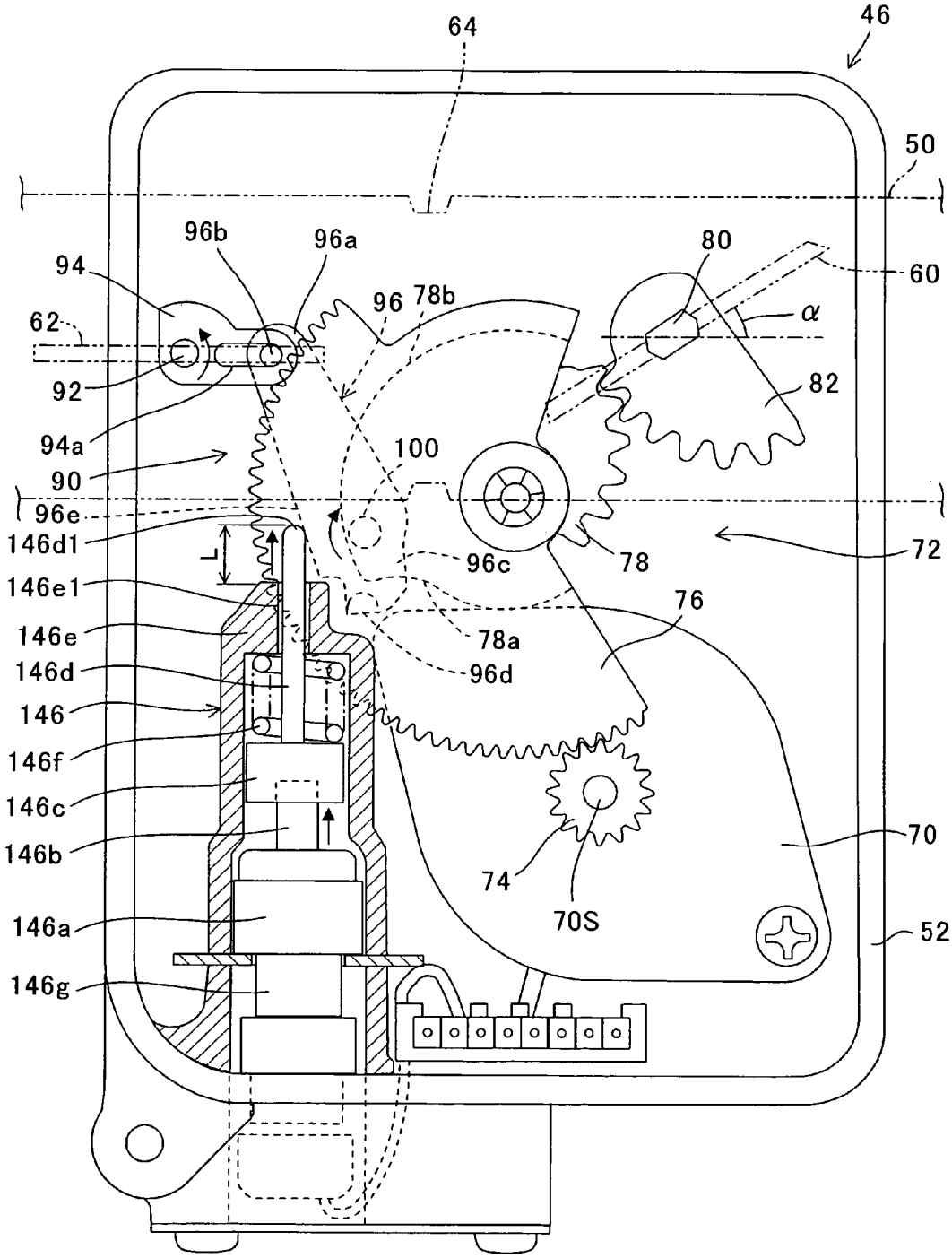
FIG. 12 is a view, similar to FIG. 10, showing the carburetor shown in FIG. 10.

FIG. 11 shows the mechanism 146 when the wax is contracted and FIG. 12 shows that when the wax is expanded. It should be noted that the throttle valve 60 is at the over-fully-opened position in FIGS. 11, 12.

In the mechanism 146, when the ambient temperature is relatively low, i.e., lower than operating temperature of the mechanism 146 which is the thermo-wax, the wax of the wax section 146*a* is contracted and it makes the projecting amount L of the drive pin 146*d* minimum. At this time, as shown in FIGS. 10, 11, the drive pin 146*d* does not abut or slightly abuts on the surface 96*e* of the link 96. In other words, when the wax is contracted, the tip 146*d*1 of the drive pin 146*d* does not abut on the surface 96*e* under condition where the link 96 holds the choke valve 62 either at the fully-opened position (FIG. 10) or at the fully-closed position (FIG. 11).

When the ambient temperature increases due to exhaust heat of the engine 10 or heat generated by the heater 146*g* and becomes higher than the operating temperature, as shown in FIG. 12, the wax is expanded to push the rod 146*b* and flange 146*c* upward in the drawing. As a result, the drive pin 146*d* acts against the urging force of the return spring 146*f* and is displaced upward in the drawing, thereby increasing the projecting amount L. The operating temperature is, for instance, set to 70° C.

Therefore, when the drive pin 146*d* is displaced due to the expansion of wax with the choke valve 62 being at the fully-closed position (FIG. 11), as shown in FIG. 12, the drive pin 146*d* presses the surface 96*e* of the link 96, whereby the link 96 is displaced or rotated clockwise about the rotation shaft 100. Accordingly, the second pin 96*d* is moved apart from the circumference of the third gear 78 and the first pin 96*b* displaces the arm 94, while sliding in the long hole 94*a*. The displacement of the arm 94 causes the choke shaft 92 to rotate counterclockwise in the drawing so as to open the choke valve 62 to the fully-opened position. Thus the drive pin 146*d* drives the choke valve opening/closing mechanism 90 (i.e., the link 96, arm 94 and the like) in response to the expansion/contraction of the wax, thereby regulating the opening of the choke valve 62.

As described in the foregoing, the second embodiment is configured such that the choke valve 62 is opened and closed by the choke valve opening/closing mechanism 90 that operates in response to the operation of the throttle valve opening/closing mechanism 72, and the opening of the choke valve 62, which is opened and closed by the mechanism 90, can be regulated by using the choke valve opening regulating mechanism 146 in response to ambient temperature.

Next, the explanation will be made on the opening and closing operation of the throttle valve 60 and choke valve 62 at starting of the engine 10.

Figure 13:
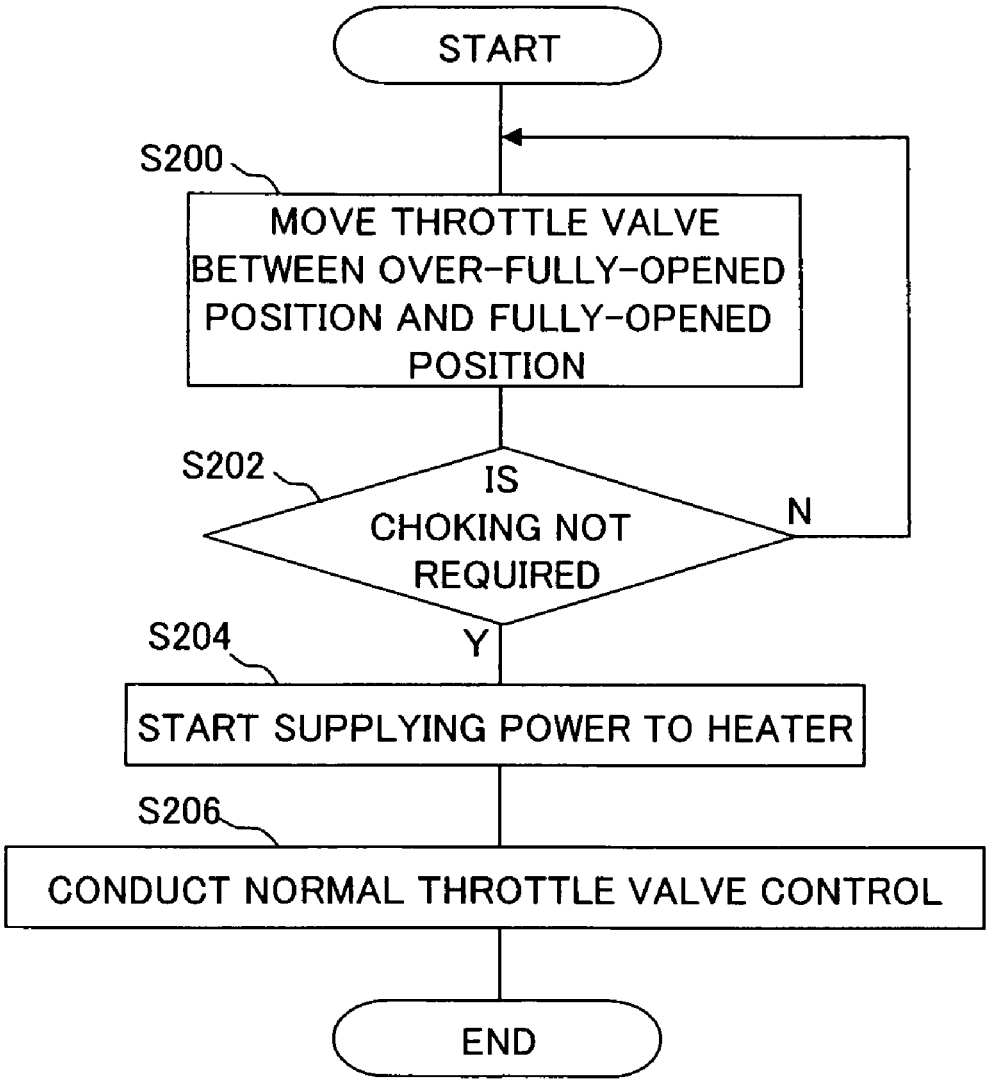
FIG. 13 is a flowchart showing the processing of controlling the operation of an actuator of the throttle valve etc., at starting of the engine.

FIG. 13 is a flowchart similar to FIG. 8, but showing the processing of this operation of the actuator executed by the ECU 112. Note that it is assumed the engine 10 is started in the so-called "cold start" manner after a specific time period has elapsed since the last engine stop, ambient temperature around the choke valve opening regulating mechanism 146 is relatively low and the wax is contracted.

The processing of the steps of S200, S202 is conducted similarly to the first embodiment. When the result in S202 is No, the program returns to S200, i.e., the processing of S200 is repeated until the determination that the choking is not required is made. At this time, the exhaust heat of the engine 10 increases with increasing engine speed. When the ambient temperature around the mechanism 146 rises to the operating temperature or more due to the exhaust heat of the engine 10, the wax is expanded to gradually project the drive pin 146*d*.

The drive pin 146*d* displaces the link 96 so as to gradually rotate the choke valve 62 in the opening direction, i.e., it decreases fuel injection quantity as ambient temperature increases along with increase in the engine speed, thereby making the rich air-fuel mixture leaner gradually. Thus, during a period until completing the heating operation after activating the ECU 112, the opening of the choke valve 62 is regulated by the mechanism 146 in response to ambient temperature.

When the result in S202 is Yes, the program proceeds to S204, in which the heater 146*g* starts being supplied with power to heat the wax section 146*a*. The resulting further expansion of wax moves (projects) the drive pin 146*d* furthermore and forcibly opens the choke valve 62 to the fully-opened position, thereby terminating the rich air-fuel mixture condition produced by the choke valve 62.

In S206, the normal control of the throttle valve 60 is conducted. Specifically, the operation of the motor 70 is controlled so as to move the throttle valve 60 between the fully-closed position and the fully-opened position. Since the throttle valve 60 is thus moved, the choke valve 62 is held at the fully-opened position, and it is held at the fully-opened position also by the drive pin 146*d* of the mechanism 146, so it becomes possible to prevent the choke valve 62 from closing while the engine 10 is in operation.

Next, the explanation will be made on the opening and closing operation of the throttle valve 60 and choke valve 62 when the engine 10 stops.

Figure 14:
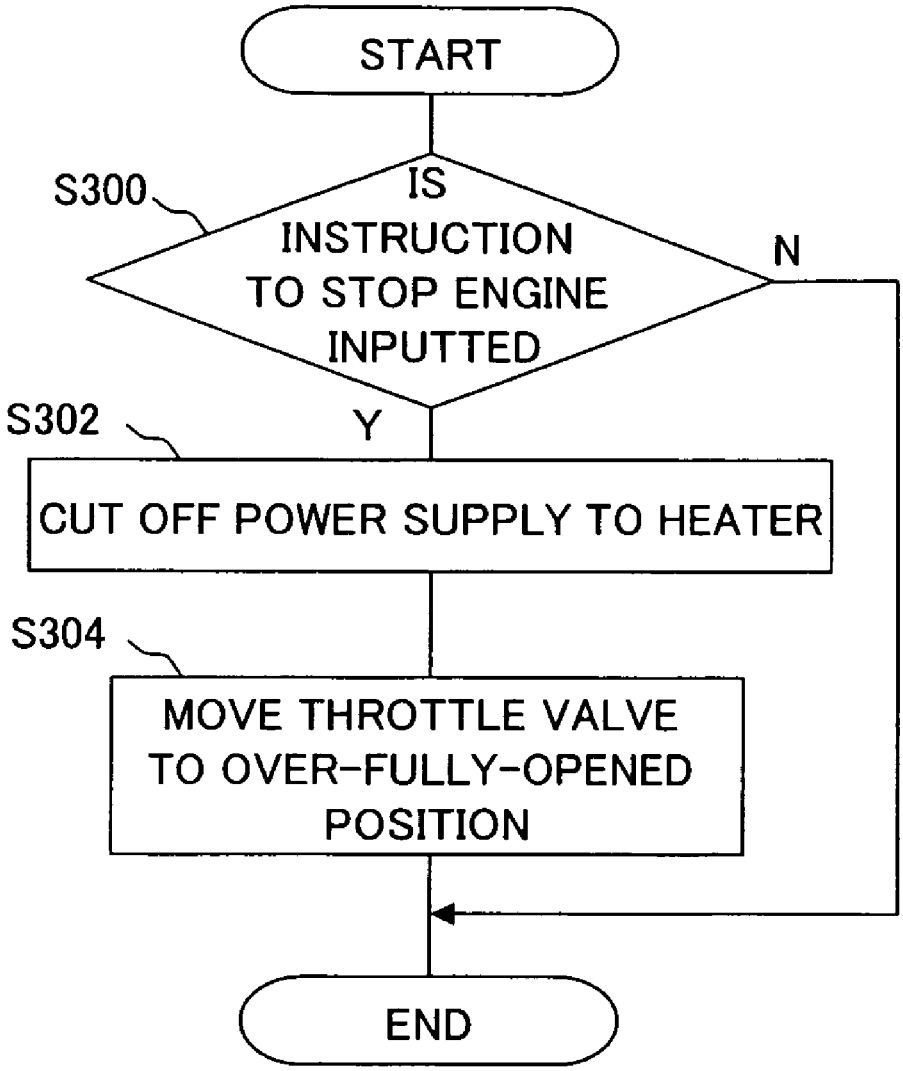
FIG. 14 is a flowchart showing the processing of controlling the operation of the actuator of the throttle valve etc., when the engine is stopped.

FIG. 14 is a flowchart similar to FIG. 9, but showing the processing of this operation of the actuator executed by the ECU 112.

In S300, it is determined whether an instruction to stop the engine 10 is inputted. When the result is No, the remaining steps are skipped and when the result is Yes, the program proceeds to S302, in which power supply to the heater 146*g* is cut off to stop heating the wax section 146*a*.

The program then proceeds to S304, in which the operation of the motor 70 is controlled so that the throttle valve 60 is moved (opened) to the over-fully-opened position. Since the throttle valve 60 is thus moved, the link 96 of the choke valve opening/closing mechanism 90 is operated to close the choke valve 62 to the fully-closed position. However, the wax is still in expanded status because the power supply to the heater 146*g* has been just cut off in S302. As a result, the drive pin 146*d* projected due to the expansion of wax remains abutting on the link 96 and the choke valve 62 is held at the fully-opened position by the drive pin 146*d*. Specifically, the choke valve 62 is not closed to the fully-closed position immediately after the engine 10 stops.

Therefore, even when the engine 10 is hot-started, i.e., the engine 10 is restarted after elapse of a short period since the last stop, the choke valve 62 stays at the fully-opened position or thereabout, thereby enabling to start the engine 10 without enriching air-fuel mixture excessively.

When a specific time period elapsed and ambient temperature around the mechanism 146 lowered, the wax is contracted, resulting in gradual decrease in the projecting amount L of the drive pin 146*d*. As shown in FIG. 11, it causes the choke valve 62 to close to the fully-closed position for preparing for the next engine start.

As described in the foregoing, since the engine according to the second embodiment is thus configured, it becomes possible to prevent the air-fuel mixture from being enriched by opening the choke valve 62 when ambient temperature is relatively high in a case of, for example, hot start, specifically, the choke valve 62 can be regulated at appropriate opening in response to ambient temperature, thereby improving fuel efficiency.

The remaining configuration and effects are the same as those in the first embodiment and will not be explained.

A general-purpose internal combustion engine according to a third embodiment of the invention will be explained.

Figure 15:
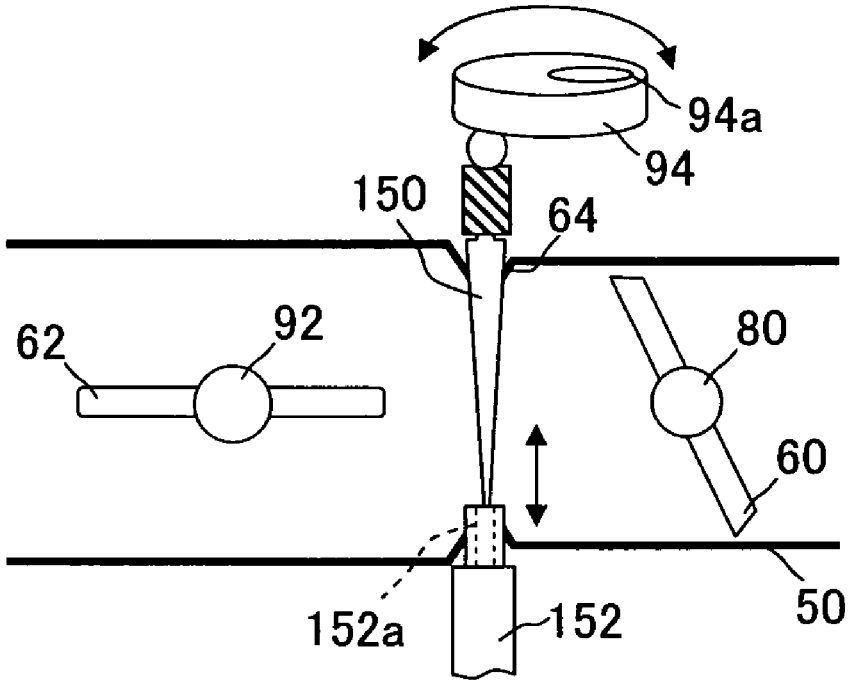
FIG. 15 is a perspective view showing the vicinity of an air intake passage of a general-purpose internal combustion engine according to a third embodiment of this invention.

FIG. 15 is a perspective view showing the vicinity of the air intake passage 50 of the engine 10 according to the third embodiment. Constituent elements corresponding to those of the first embodiment are assigned with the same reference symbols as those in the first embodiment and will not be explained.

The explanation will be made with focus on points of difference from the first embodiment. In the third embodiment, fuel-cut is conducted using a fuel-cut needle valve 150 in place of the FS valve 106, and the needle valve 150 is moved by the arm 94. The choke valve 62 is manually manipulated by the operator in the third embodiment.

Explaining specifically, the needle valve 150 is connected to the arm 94 and a jet orifice 152*a* of a main nozzle 152 can be sealed in response to rotation (displacement) of the arm 94. More specifically, when the throttle valve 60 is at a position between the fully-closed position and the fully-opened position, the needle valve 150 is positioned to make the jet orifice 152*a* open for enabling fuel to inject from the main nozzle 152. On the other hand, when the throttle valve 60 is moved to the over-fully-opened position, the arm 94 is rotated to move the needle valve 150 downward in the drawing so as to seal the jet orifice 152*a*, thereby cutting off supply of fuel.

Owing to this configuration, when the throttle valve 60 is moved between the fully-closed position and the fully-opened position, i.e., the throttle valve 60 is normally operated, the needle valve 150 is positioned to make the jet orifice 152*a* open, thereby enabling fuel to inject from the main nozzle 152. In a case where the throttle valve 60 is configured to move to the over-fully-opened position when the engine 10 is stopped, the needle valve 150 is moved downward so as to seal the jet orifice 152*a*, thereby cutting off fuel supply.

As described in the foregoing, the engine according to the third embodiment is configured such that the motor 70 moves both the throttle valve 60 and the fuel-cut needle valve 150. With this, in a case of additionally installing an automatic fuel cut-off device in the engine 10, the needle valve 150 can be moved without the need of another electric motor, saving space to be required for installment of a motor for the needle valve 150.

The remaining configuration and effects are the same as those in the first embodiment and will not be explained.

As stated above, the first to second embodiments are configured to have a general-purpose internal combustion engine having a throttle valve (60) and a choke valve (62) each installed in an air intake passage (50) connected to a combustion chamber (16), air sucked in flowing through the air intake passage mixes with fuel to generate an air-fuel mixture that enters the combustion chamber of a cylinder (12) and ignited to drive a piston (14) to rotate a crankshaft (30) to be connected to a load, comprising: an actuator (electric motor 70), a throttle valve opening/closing mechanism (72) connected to the actuator to open/close the throttle valve; and a choke valve opening/closing mechanism (90) connected to the throttle valve opening/closing mechanism to open/close the choke valve in response to operation of the throttle valve opening/closing mechanism. With this, it becomes possible to move the choke valve 62 by the motor 70 for driving the throttle valve 60, i.e., move both the throttle valve 60 and the choke valve 62 solely by the motor 70.

In the engine, the throttle valve opening/closing mechanism opens/closes the throttle valve within a range between a fully-closed position and an over-fully-opened position over a fully-opened position by predetermined opening a in response to the operation of the actuator, and the choke valve opening/closing mechanism holds the choke valve at a fully-opened position when the throttle valve is positioned between the fully-closed position and the fully-opened position, while opening/closing the choke valve within a range between the fully-opened position and a fully-closed position when the throttle valve is positioned between the fully-opened position and the over-fully-opened position. With this, it becomes possible to move both the throttle valve 60 and the choke valve 62 solely by the motor 70 further reliably.

In the engine, the throttle valve opening/closing mechanism comprises a plurality of gears (74, 76, 78, 82). With this, the throttle valve opening/closing mechanism can be simple in structure.

In the engine, the throttle valve opening/closing mechanism comprises at least a first gear (74) connected to an output shaft (70S) of the actuator and a second gear (76) engaged with the first gear. With this, the throttle valve opening/closing mechanism can be simple in structure.

In the engine, the choke valve opening/closing mechanism comprises a link (96) connected at its one end with a choke shaft (92) that supports the choke valve and at its other end with the throttle valve opening/closing mechanism, the link being adapted to displaced in response to the operation of the throttle valve opening/closing mechanism to rotate the choke shaft to open/close the choke valve. With this, the opening of the choke valve 62 can be regulated with simple structure, thereby saving space further.

The engine according to the second embodiment further includes: a choke valve opening regulating mechanism that regulates opening of the choke valve opened/closed by the choke valve opening/closing mechanism in response to ambient temperature. With this, it becomes possible to regulate the choke valve 62 at appropriate opening in response to ambient temperature, thereby improving fuel efficiency.

In the engine according to the second embodiment, the choke valve opening regulating mechanism comprises a wax section (146*a*) filled with wax that is adapted to expand/contract in response to the ambient temperature, a drive pin (146*d*) connected to the wax section, the drive pin driving the choke valve opening/closing mechanism in response to expansion/contraction of the wax to regulate the opening of the choke valve. With this, the opening of the choke valve 62 can be regulated with the simple structure, thereby saving space further.

In the engine according to the second embodiment, the choke valve opening/closing mechanism further includes a heater (146*g*) that heats the wax section. With this, it becomes possible to hold the choke valve 62 at the fully-opened position after the warm-up operation is completed by heating the wax section 146*a* by the heater 146*g* and driving the choke valve opening/closing mechanism 90 through the drive pin 146*d* utilizing the expansion of wax, i.e., to forcibly hold the choke valve 62 at the fully-opened position after the warm-up operation. Therefore, it becomes possible to reliably prevent the choke valve 62 from closing while the engine 10 is in operation. Also, even when the engine 10 is hot-started, i.e., the engine 10 is restarted after elapse of a short period since the last stop, the choke valve 62 stays at the fully-opened position or thereabout, thereby enabling to further improve fuel efficiency without enriching air-fuel mixture excessively.

The engine according to the second embodiment further includes: a heating stopper that stops the heater from heating the wax section when an operator inputs an instruction to stop the engine (S302). With this, it becomes possible to efficiently heat the wax section 146*a* in response to the operating condition of the engine 10.

The engine according to the first to third embodiments further includes: an actuator controller that controls operation of the actuator such that the throttle valve is opened to the over-fully-opened position when an operator inputs an instruction to stop the engine (S304). With this, it becomes possible to close the choke valve 62 to the fully-closed position when the engine 10 stops, thereby improving the starting performance of the engine 10.

In the engine according to the first to third embodiments, since the actuator is an electric motor, the above-mentioned effects can be achieved with simple structure.

It should be noted that, although the actuator (motor 70) for opening and closing the throttle valve 60 and the like is exemplified as a stepper motor in the foregoing description, it can instead be any of various other kinds of electric motor, electromagnetic solenoid, or hydraulic equipment that is operated by driving its pump by a motor.

It should also be noted that, although in the foregoing the choke valve 62 (first and second embodiments) or the needle valve 150 (third embodiment) is moved in response to the operation of the throttle valve opening/closing mechanism 72, a cock valve for performing fuel cut-off can instead be moved, for instance.

It should also be noted that, although fuel is supplied by the carburetor 46, it is not limited thereto and an injector (fuel injection valve) can be disposed at the intake port 24 for supplying fuel.

Japanese Patent Application Nos. 2008-115605 and 2008-115606 both filed on Apr. 25, 2008, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A general-purpose internal combustion engine having a throttle valve and a choke valve each installed in an air intake passage connected to a combustion chamber, air sucked in flowing through the air intake passage and mixing with fuel to generate an air-fuel mixture that enters the combustion chamber of a cylinder and is ignited to drive a piston to rotate a crankshaft to be connected to a load, said engine comprising:

an actuator;

a throttle valve opening/closing mechanism connected to the actuator to open/close the throttle valve; and a choke valve opening/closing mechanism connected to the throttle valve opening/closing mechanism to open/close the choke valve in response to operation of the throttle valve opening/closing mechanism;

wherein the throttle valve opening/closing mechanism comprises a plurality of gears.

2. The engine according to claim 1, wherein the throttle valve opening/closing mechanism opens/closes the throttle valve within a range between a fully-closed position and an over-fully-opened position over a fully-opened position by predetermined opening in response to the operation of the actuator, and the choke valve opening/closing mechanism holds the choke valve at a fully-opened position when the throttle valve is positioned between the fully-closed position and the fully-opened position, while opening/closing the choke valve within a range between the fully-opened position and a fully-closed position when the throttle valve is positioned between the fully-opened position and the over-fully-opened position.

3. The engine according to claim 2, further including:

an actuator controller that controls operation of the actuator such that the throttle valve is opened to the over-fully-opened position when an operator inputs an instruction to stop the engine.

4. The engine according to claim 2, wherein during operation, the choke valve opening/closing mechanism is always operated by the throttle valve opening/closing mechanism.

5. The engine according to claim 1, wherein the plurality of gears comprises at least a first gear connected to an output shaft of the actuator and a second gear engaged with the first gear.

6. The engine according to claim 1, wherein the choke valve opening/closing mechanism comprises a link connected at its one end with a choke shaft that supports the choke valve and at its other end with the throttle valve opening/closing mechanism, the link being adapted to be displaced in response to the operation of the throttle valve opening/closing mechanism to rotate the choke shaft to open/close the choke valve.

7. The engine according to claim 1, further including: a choke valve opening regulating mechanism that regulates opening of the choke valve opened/closed by the choke valve opening/closing mechanism in response to ambient temperature.

8. The engine according to claim 7, wherein the choke valve opening regulating mechanism comprises a wax section filled with wax that is adapted to expand/contract in response to the ambient temperature, a drive pin connected to the wax section, the drive pin driving the choke valve opening/closing mechanism in response to expansion/contraction of the wax to regulate the opening of the choke valve.

9. The engine according to claim 8, wherein the choke valve opening/closing mechanism further includes:

a heater that heats the wax section.

10. The engine according to claim 9, further including:

a heating stopper that stops the heater from heating the wax section when an operator inputs an instruction to stop the engine.

11. The engine according to claim 1, wherein the actuator is an electric motor.

12. The engine according to claim 1, further comprising a motor case arranged on said intake port; wherein said motor case is configured to receive the actuator, the throttle valve opening/closing mechanism and the choke valve opening/closing mechanism therein.

13. The engine according to claim 1, wherein said plurality of gears comprises a first gear operatively connected with said actuator;

a second gear engaged with said first gear;

a third gear arranged coaxially with the second gear, and being operable to integrally rotatable therewith; and a fourth gear engaged with the third gear, and connected with the throttle valve via a throttle shaft.

14. A carburetor unit for an engine, comprising an air intake passage having a downstream side thereof connected to an intake port of the engine, and an upstream side thereof connected to an air cleaner, a motor case arranged on the air intake passage;

a carburetor assembly;

a throttle valve installed in the air intake passage;

a choke valve arranged in an upstream side of the throttle valve;

an actuator;

a throttle valve operating mechanism directly connected with the actuator, said throttle valve operating mechanism being operable to open/close the throttle valve; and a choke valve operating mechanism operatively connected with the throttle valve operating mechanism, wherein operation of the choke valve operating mechanism is controlled by the throttle valve operating mechanism;

wherein the throttle valve opening/closing mechanism comprises a plurality of gears.

15. A carburetor unit for an engine according to claim 14, wherein the throttle valve operating mechanism opens/closes the throttle valve within a range between a fully-closed position and an over-fully-opened position over a fully-opened position by predetermined opening in response to the operation of the actuator, and the choke valve operating mechanism holds the choke valve at a fully-opened position when the throttle valve is positioned between the fully-closed position and the fully-opened position, while opening/closing the choke valve within a range between the fully-opened position and a fully-closed position when the throttle valve is positioned between the fully-opened position and the over-fully-opened position.

16. A carburetor unit for an engine according to claim 14, wherein the plurality of gears comprises a first gear operatively connected with said actuator;

a second gear engaged with said first gear;

a third gear arranged coaxially with the second gear and operable to integrally rotatable therewith; and a fourth gear engaged with the third gear and connected with the throttle valve via a throttle shaft.

17. A carburetor unit for an engine according to claim 14, further comprising a choke valve opening regulating mechanism that regulates opening of the choke valve opened/closed by the choke valve operating mechanism.

* * * * *